US005553604A

United States Patent [19]

Frei

[11] Patent Number: 5,553,604

[45] Date of Patent: Sep. 10, 1996

[54] SPACE HEATING SYSTEM, HEATER, AND COMBUSTION CHAMBER

[76] Inventor: Martin Frei, Hangetweg 24, CH-9434 Au/SG, Switzerland

[21] Appl. No.: 227,602

[22] Filed: Apr. 14, 1994

[51] Int. Cl.[6] ..... F24B 1/188

[52] U.S. Cl. ..... 126/523; 126/515; 126/517; 126/77; 126/61; 126/58; 126/66

[58] Field of Search ..... 126/523, 502, 126/58, 544, 61, 545, 66, 546, 547, 551, 190, 77, 191, 515, 517

[56] References Cited

U.S. PATENT DOCUMENTS

| | | | |
|---|---|---|---|
| 4,043,313 | 8/1977 | Sherman | 126/502 |
| 4,069,973 | 1/1978 | Edwards | 126/617 X |
| 4,181,118 | 1/1980 | Mummert | 126/617 X |
| 4,843,674 | 7/1989 | Jones | 15/147 R |
| 4,856,491 | 8/1989 | Ferguson et al. | 126/77 |
| 4,884,556 | 12/1989 | Alden et al. | 126/545 X |
| 5,009,219 | 4/1991 | Liet | 126/523 |
| 5,333,601 | 8/1994 | Hill | 126/523 |

FOREIGN PATENT DOCUMENTS

| | | |
|---|---|---|
| 389381B | 11/1989 | Austria . |
| 0480870A1 | 4/1992 | European Pat. Off. . |
| 1063966 | 5/1954 | France . |
| 2574161 | 6/1986 | France . |
| 2654496 | 5/1991 | France . |
| 87 03 014.4 | 5/1987 | Germany . |
| 675467A5 | 9/1990 | Switzerland . |
| 784172 | 10/1957 | United Kingdom . |
| 2172989A | 10/1986 | United Kingdom . |

*Primary Examiner*—Larry Jones
*Attorney, Agent, or Firm*—Frishauf, Holtz, Goodman, Langer & Chick, P.C.

[57] ABSTRACT

The space heating system has a stove (1, 2) with a sealed combustion chamber (3); air is heated in the stove in a heat exchanger (12) therein, and heated air is conducted through hollow blocks (80) of chamotte arranged, for example, as heating panels, heated walls, benches, floors or the like. The hollow blocks are formed, internally, with projections or obstructions (83) to increase heat transfer, and may be faced at the outside with decorative tiles. To seal the combustion chamber, a vertically movable panel, typically of fire-resistant glass, is slidably located in front of a fuel inlet opening (7). In operation, the panel is sealed, so that the combustion chamber (3) will receive air only under controlled conditions, in two air paths; a primary air path supplies air to a narrow space (22) below a fuel support grate (25), after being preheated by passing around an ash receiver (18); and a secondary air flow, passed through ducts (30) within the combustion chamber, and ejecting air towards the panel. Typical fuels are wood or coal.

19 Claims, 11 Drawing Sheets

SPACE HEATING SYSTEM, HEATER, AND COMBUSTION CHAMBER

FIELD OF THE INVENTION

The present invention relates to a space heating system and a heater or stove having a sealed combustion chamber, and a stove construction therefor, and more particularly to an arrangement which permits heating walls or large surfaces with hot air from a space heater giving the illusion of a fireplace.

BACKGROUND

Various types of space heaters, particularly designed for placement in inhabited spaces, such as living rooms or the like, provide combustion chambers, and include heat exchangers located in heat transfer relationship to the combustion gases emanating from the combustion chamber to heat air within the heat exchanger, which then is used to heat the surrounding space. The combustion chamber can be closed off by a transparent panel or window to give the illusion of an open fireplace. The referenced disclosure, European Published Application 0 480 870 A1, by the inventor hereof, shows one construction of this type.

THE INVENTION

It is an object to provide a space heating system, including a stove having a combustion chamber, which permits combustion essentially free from polluting exhaust gases, and has a high heat output efficiency, while being capable of accepting fuels such as wood, coal or the like; which is arranged so that a visible flame, once ignited, will not extinguish while controlling the rate of burning of the fuel, and in which heat generated during combustion can be stored for gradual radiation in the space to be heated.

Briefly, preheated combustion air is supplied to the combustion chamber in two paths, one providing primary air directly below a grate on which fuel is retained, and another providing secondary air which is guided through suitable air ducts located within the combustion chamber, and then supplied to the combustion chamber from above. This arrangement preheats air for combustion by contact with an ash receiver in the primary path; and by being preheated in the air ducts within the combustion chamber in the secondary path. The combustion is controlled by controlling admitted combustion air and sealing a slidable panel or window which, otherwise, provides an opening into the combustion chamber for loading of the fuel. When the stove is operating, the window is sealed by a pressure engagement arrangement against the frame surrounding the opening so that only so much air as is controllably admitted can reach the combustion chamber.

The stove includes a heat exchanger located above the combution chamber, and taking air either from outside and/or recirculated from within the space to be heated, and then guided through hollow heat storage blocks, for example made of stone or a stone material. The blocks are so arranged that the space therein, through which hot air can circulate, can be joined to similar spaces in adjacent blocks, either in alignment or rotated for example by 90° or some other angles. The stones can then be placed next to each other in any decorative arrangement, for example in form of a wall, a panel, or of a bench, for example surrounding the stove itself. The slidable window panel of the stove which, in operation, is sealed, can be formed of a heat resistant window material.

The arrangement provides for combustion with minimal emission of polluting exhaust gases, while providing for high efficiency in use of the combustion heat of the fuel, which, for example, can be wood or coal, thereby providing the illusion of an open fireplace, but with substantially increased efficiency, or coal. The combustion air is preheated both in the primary and secondary paths, and so dosed or measured that the flame will not extinguish while, at the same time, controlling the rate of combustion of the fuel, without generating polluting smoke.

The transparent panel is preferably so arranged that, when in front of a fuel supply opening, it can be locked in air-tight, sealed position against the combustion chamber, so that only so much air as is to be controllably supplied will reach the fuel during combustion. This ensures combustion with minimum pollution and maximum efficiency.

DRAWINGS

DETAILED DESCRIPTION

Figure 1:
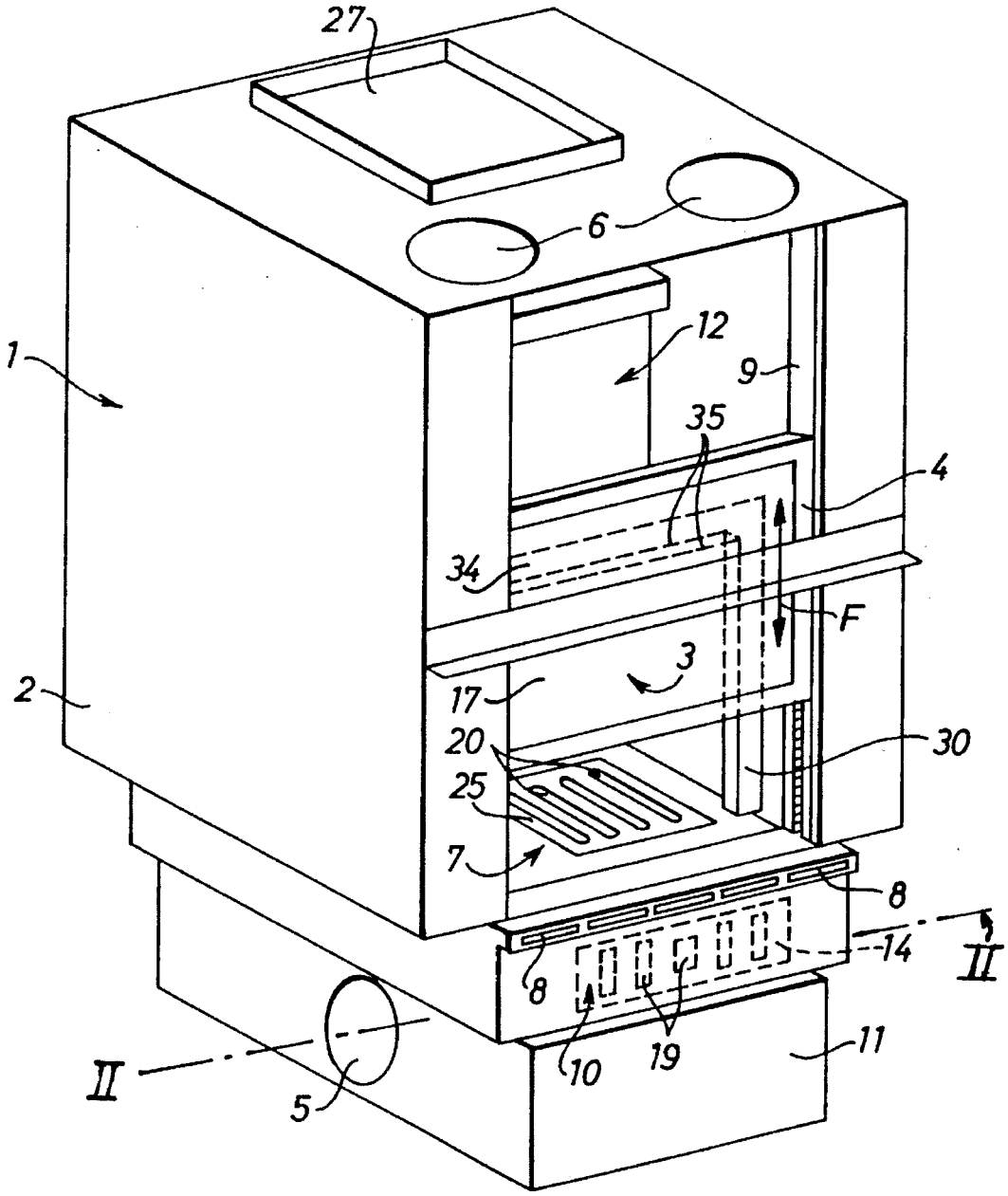
FIG. 1 is a highly perspective view of the stove.
Figure 2:
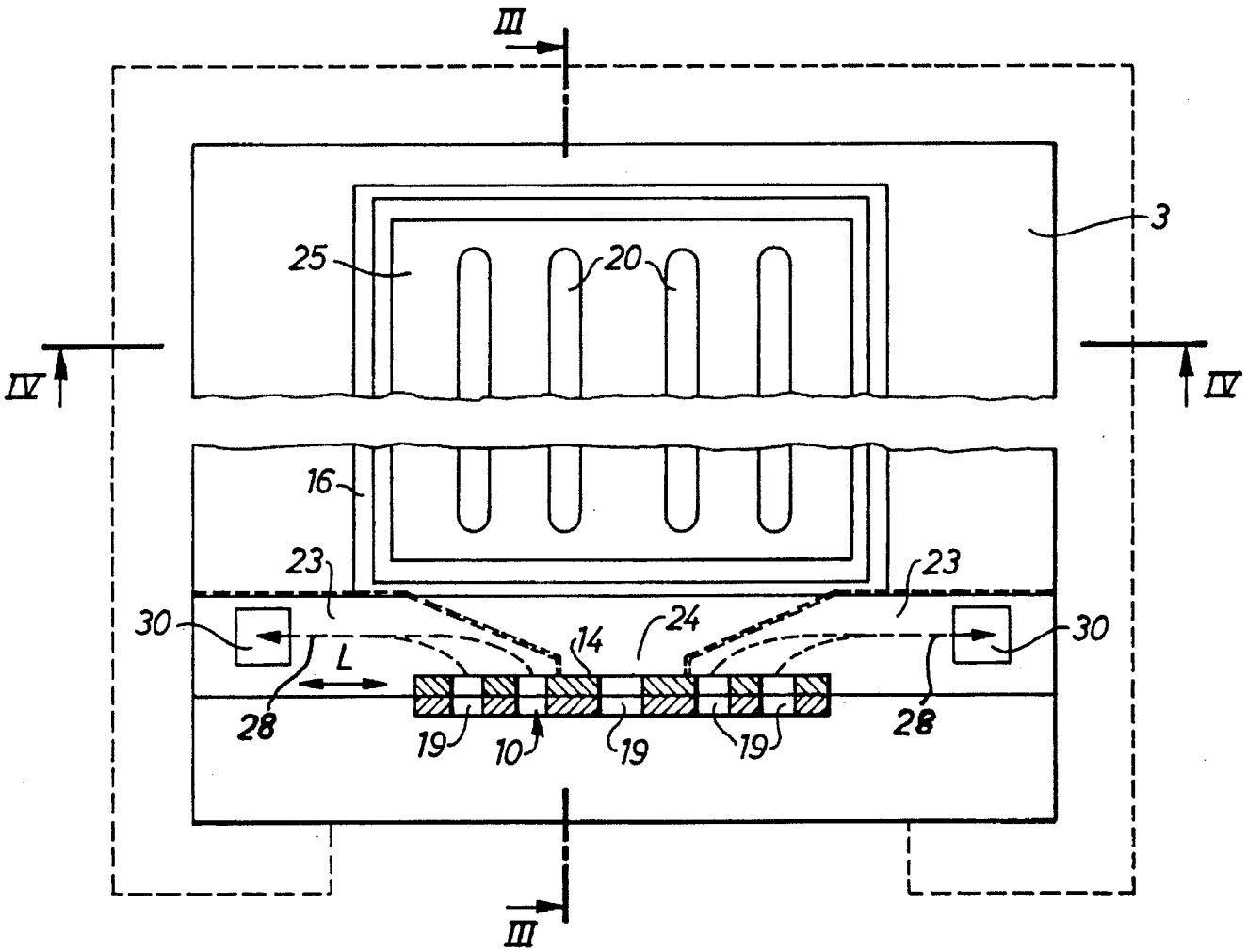
FIG. 2 is a schematic cross section through the stove, eliminating elements not necessary for an understanding of the invention, and taken along line II—II of FIG. 1, looking upwardly.

Referring first to FIG. 1:

The stove which is part of the space heating system can have any suitable outer shape; as shown in FIGS. 1 and 2, the cross section of the stove is rectangular although, for example, it can be essentially hexagonal or part-hexagonal (see FIG. 20) or of other shape. The stove 1 has side walls 2 of dead-burned fire clay or chamotte, in form of bricks, slabs or the like, lining a combustion chamber 3. The stove is surrounded by an outer jacket of metal, typically steel. The combustion chamber 3 is closed laterally, and is accessible from the front to introduce fuel through a fuel inlet opening 7.

In accordance with a feature of the invention, a panel 17 is so secured in the stove 1 that, when the stove is in operation, it will seal the opening 7 and prevent any exchange of air between the inside of the combustion chamber and the outside through the opening 7. As illustrated, a frame 4 is located in the stove body, which retains a panel 17, typically of heat resistant glass. The frame 4 and panel 17 are slidable vertically on suitable guide structures of the stove 1. Preferably, a counterweight is provided, so that the panel 17 and the frame 4 therefor can be easily slid vertically. Additionally, the panel 17 can be arranged to pivot about a vertical axis, to form a door.

A typical fuel for the stove is wood, cut into fireplace logs. Other fuels may be used, for example coal or the like.

The stove has a lower portion 11, likewise part of the stove 1 and airtightly closed with respect thereto. It is formed with an air supply pipe connection 5, to supply heating air which, after heating in a heat exchanger 12 located in the upper portion of the stove 1, can be emitted through two heated air outlet openings 6. The stove, further, is formed with a combustion gas or flue opening 27, for coupling to a suitable stove pipe or chimney.

Air is supplied to the combustion chamber 3 under controlled condition. To provide such controlled combustion air, the front side of the stove is formed with a plurality of slit-like openings 8, positioned below the combustion chamber. The openings 8 form part of a throttled air supply arrangement 10, and can selectively be closed by a slider 14 formed with slits 19 (see FIG. 2). The slider 14 can be operated by hand, moved back and forth in the direction of the double arrow L, or can be controlled, for example, automatically by a motor, linearly moving the slider in the direction of the double arrow L, and controlled with respect to overlap of matching openings or slits 8 and 19, or with respect to time or under a combination of both parameters, in order to control air supply to the combustion chamber based on quantity and time.

Separate air duct systems providing air paths 23, 24 are provided after the air has passed the air measuring system 10. The respective ducts 23, 24 separate the air into primary air 26 and secondary air 28.

The primary air 26 is guided through the duct 24 in a space 21 beneath and around the grate 25, and adjacent the ash receiver 18. The primary air then reaches an essentially rectangular frame 16, surrounding the ash receiver 18. The frame 18 is formed with holes or slits 32, so that the primary air 26 can pass into a flat, narrow space 22 between the upper side of the ash receiver 18 and the bottom of the grate 25. The grate 25 is formed with a plurality of longitudinal openings 20 through which primary air is supplied to the fuel from below, as schematically shown by the arrows K in FIG. 3. The grate 25 is so constructed that the longitudinal spaces 20 are defined by spaced ribs 25', of essentially square cross section and located on edge, in diamond form. Fuel, for example split logs of wood, then will lie on the upper edges of the ribs 25'. The space 21, which adjoins the duct 24 for the primary air, is completely surrounded at its outer circumference. Thus, the primary air necessarily must pass into the frame 16 and through the slits 32, to then flow, in essentially horizontal direction, into the space 22, and escape through the openings 20, upwardly in the direction of the arrows K to the actual flame or combustion point. The primary air, thus, is heated on the hot grate, and by passing around the ash receiver 18. The ash receiver 18 is open towards the top and has an externally projecting flange which overlaps the frame 16 to suspend ash receiver 18 on frame 16.

Figure 3:
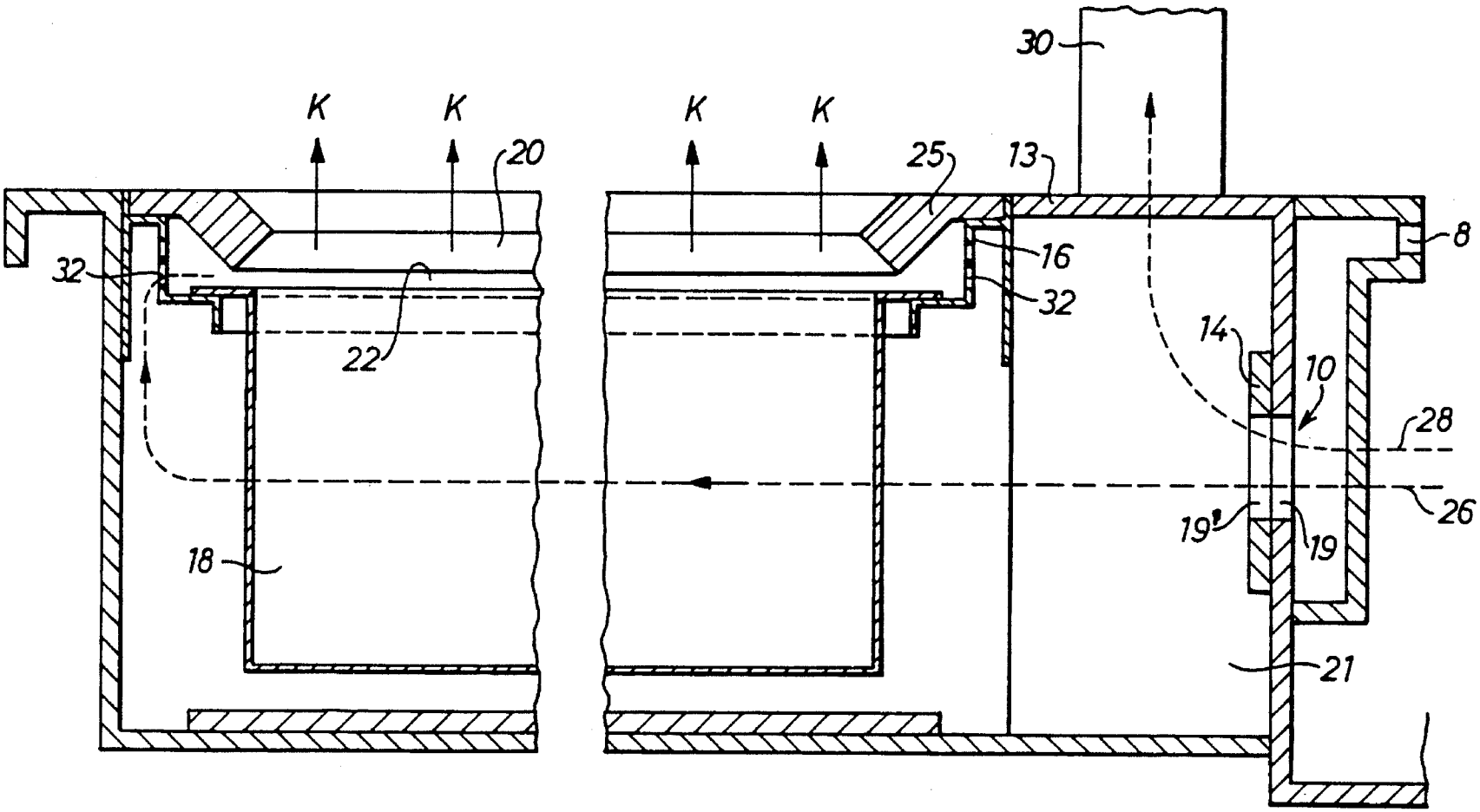
FIG. 3 is a cross section along line III—III of FIG. 2.
Figure 4:
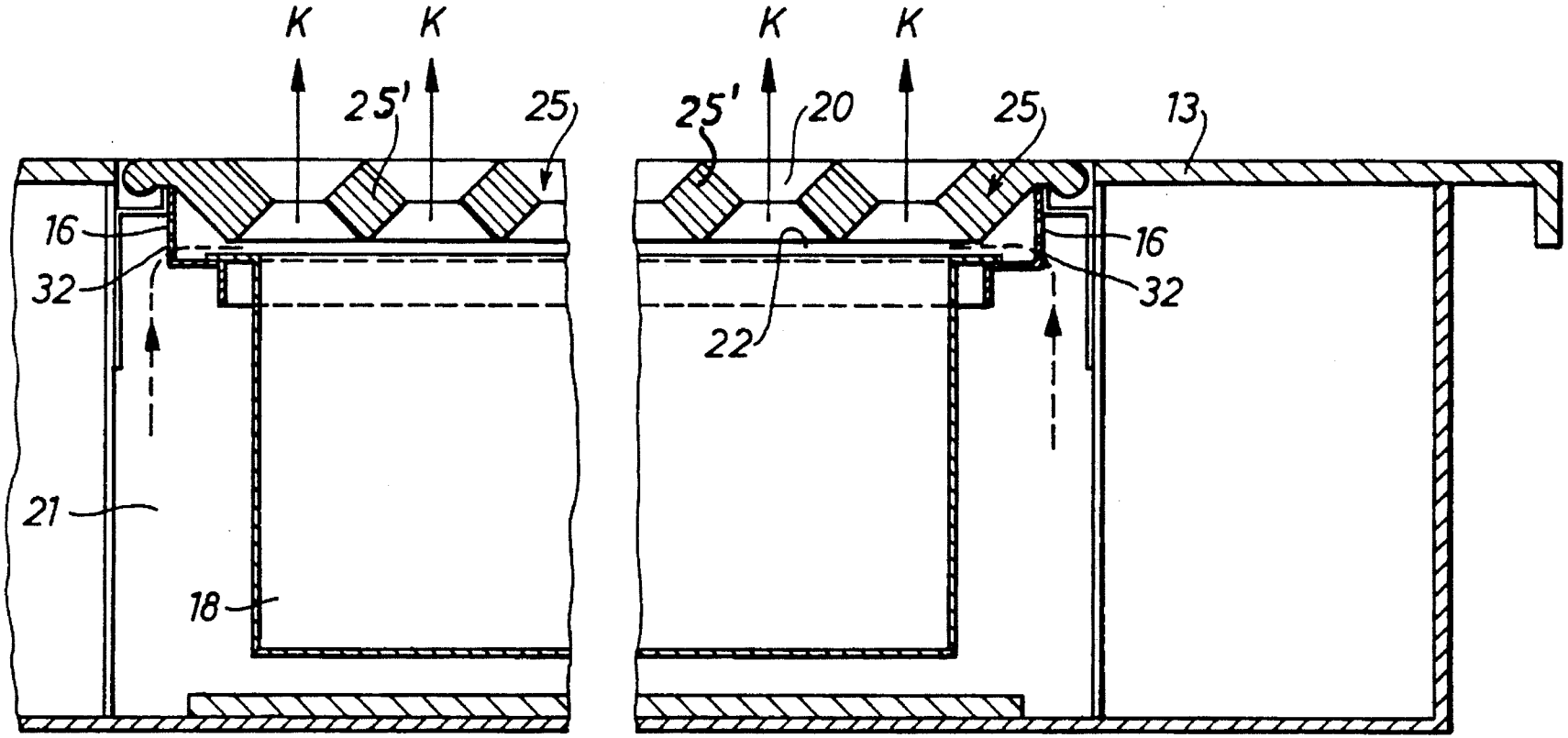
FIG. 4 is a cross section along line IV—IV of FIG. 2.

In accordance with a feature of the invention, secondary air 28, see FIG. 3, is conducted through vertical air ducts 30 located within the combustion chamber 3. The vertical air ducts 30, typically of metal, are located close to the front side of the combustion chamber. They are connected at their upper end by a horizontally located cross-connecting duct 34. The cross-connecting duct 34, see FIG. 1, is formed with air outlet openings 35. These air outlet openings 35, typically, are slits, and so arranged that the secondary air 28 is directed towards the window or panel 17, so that combustion gases are deflected away from the window or panel 17. Generally, however, the secondary air is supplied to the combustion chamber from above. The vertical ducts 30 as well as the cross-connecting duct 34 are located within the combustion chamber and hence the secondary air is preheated before it leaves the slits 35 of the cross duct 34, which further improves the combustion of fuel in the stove, enhances combustion efficiency and decreases polluting gases.

Combustion air, thus, is solely supplied through the measured air inlet throttle arrangement 10, and none is supplied under uncontrolled condition into the combustion chamber 3. In operation, the panel 17 completely seals the fuel supply opening 7.

Figure 5:
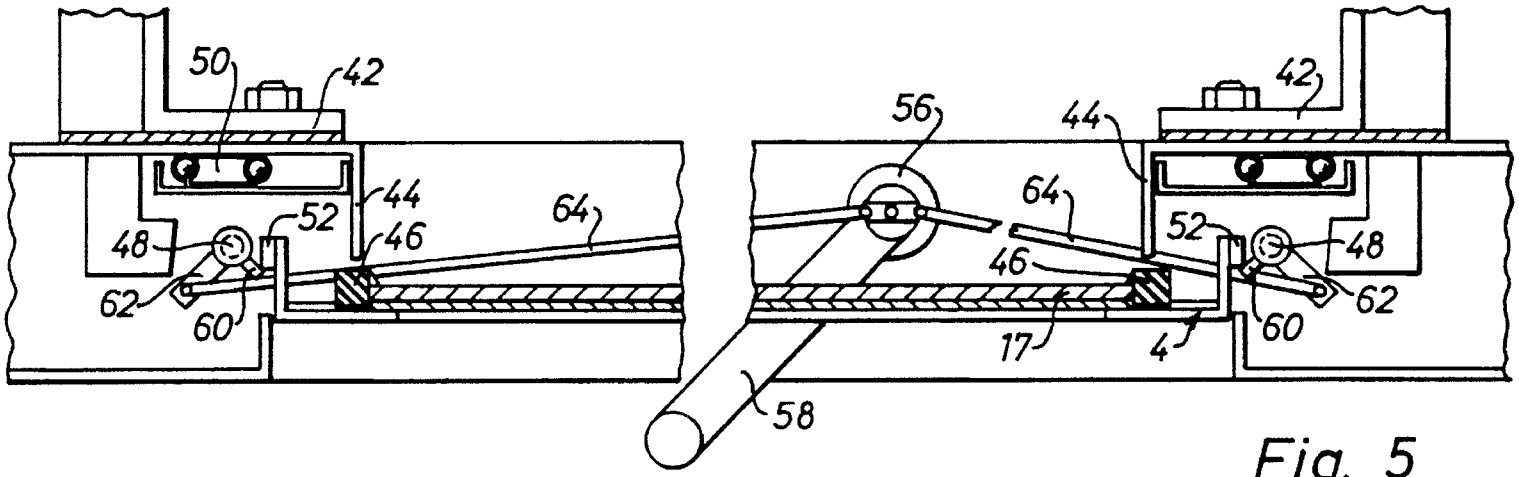
FIG. 5 is a cross section through the vertically positionable panel or window with a frame, and shown in the condition permitting movement, that is, unsealed.
Figure 6:
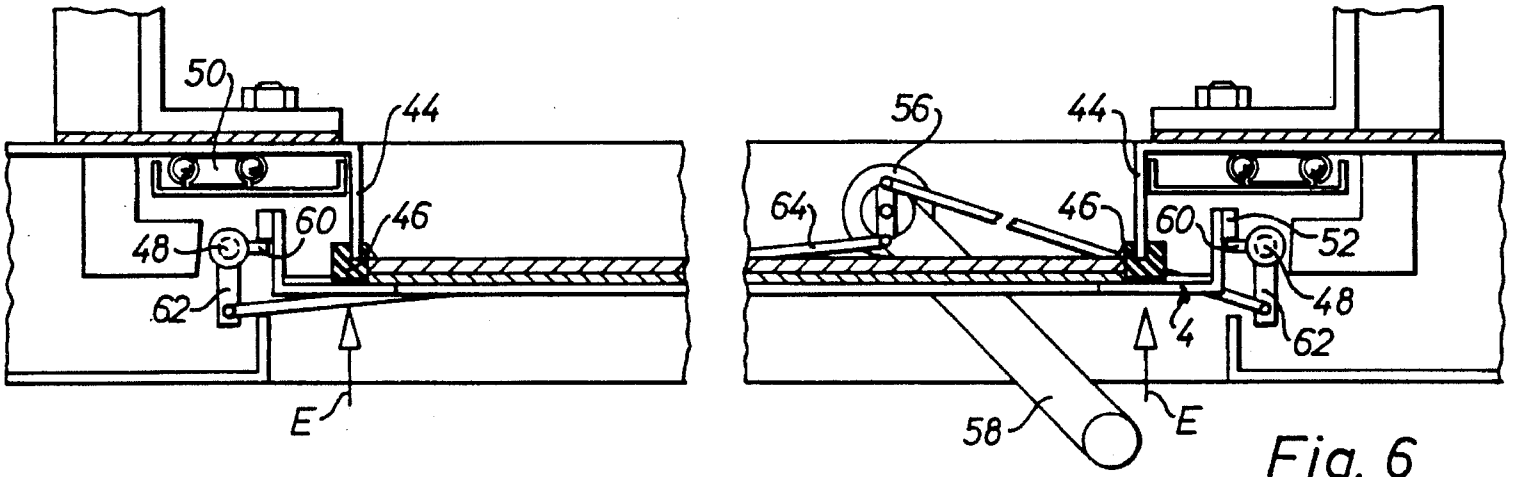
FIG. 6 is a view similar to FIG. 5 and illustrating sealing of the panel or window.

The sealing arrangement of the slidable panel 17 is best seen in FIGS. 5 and 6.

The panel 17, preferably, is made of flame-resistant, high temperature resistant glass, which is transparent to permit viewing the combustion process. Around the edges, the panel or window 17 includes a heat insulation layer. The frame 4 for the panel 17 has, in cross section, generally U shape, with the open side or legs of the U facing the interior of the combustion chamber 3. A resilient, somewhat compressible sealing strip 46 is located in the frame 4, surrounding the window or panel 17.

The frame 4, surrounding the window or panel 17, faces an interior, fixed or stationary frame 42, secured to the body of the stove 1. The window can be pressed against the interior frame 42, as will appear, and is clearly seen by comparing FIGS. 5 and 6.

The frame 4 can be adjusted vertically, either to clear the opening 7 or to be in .front thereof. The height adjustable frame 4 slides on two vertical roller tracks 50, located laterally from the frame 4. The stationary frame 42 has four legs 44 surrounding the opening 7 which extend at right angles to the surface of the panel 17, and which cooperate with the sealing strip 46 on the panel frame 4.

Figure 9:
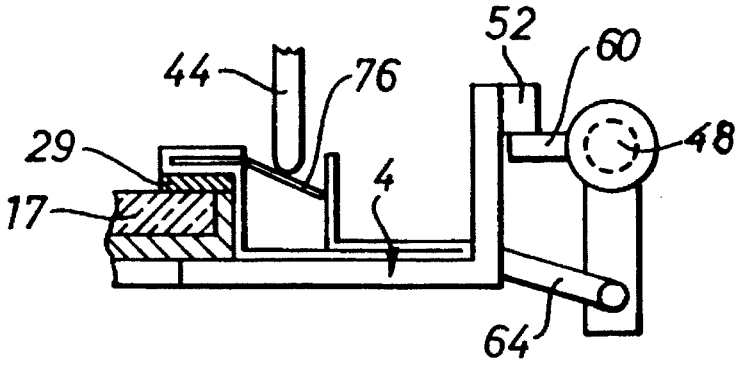
FIG. 9 is a fragmentary cross section illustrating another sealing arrangement for the panel.

In another embodiment, the sealing element can be formed as a flexible metal leaf spring 76 which, upon engagement with the legs 44, forms a tight sealing closure. FIG. 9 illustrates this alternative.

Rather than using a sealing bead or strip 46 made of flame-resistant, heat-resistant material, the flexible leaf spring 76, extending throughout the length of the circumference surrounding opening 7 is provided. The spring 76 is secured in a frame bracket 4' which, in turn, is secured on the frame 4 and clamps the window or panel 17 with an intermediate sealing element 29 of flame-resistant and heat-resistant material.

When the panel 17, together with the frame, is moved in the direction of the arrow E, as will appear below, the leg 44 on the stationary frame portion 42 presses against the resilient spring 76 and forms a tight seal between the stationary frame 42 and the movable frame 4.

The frame 4 is pressed towards the bracket 44 by pressing elements, described in connection with FIGS. 5 through 8.

FIG. 5 illustrates the frame 4 in non-engaged or relaxed, non-sealing condition. A space 37 (FIG. 7) is left between the end of the leg 44 of frame 42 and the top of the sealing strip 46, or of the spring 76, respectively. To seal the window, the frame 4 is moved, in FIG. 6 upwardly, in the direction of the arrows E, to engage the angle 44 of frame 42 against the sealing strip 46 or the sealing spring 76. The engagement mechanism includes vertical rods 48 which can be rotated or pivoted about a vertical axis. They are retained in bearings 54 (FIG. 8). Each of the rods 48 is formed with a radially extending projection or nose 60; at the lower end, they are formed with a radially extending perforated projection or bracket 62. The two brackets 62, one on each one of the rods 48, are engaged by a pull link 64, each of which is coupled to a common rotary element, in form of a rotary disk 56, suitably retained in a stationary part of the body 1 of the stove, for rotation about a fixed axis. The disk 56 is coupled to a hand lever 58. Upon moving the hand lever from the position shown in FIG. 5 to the position shown in FIG. 6 towards the right, rods 48 are pivoted about their axes and, with this pivoting movement, the projections or noses 60 move upwardly—compare FIGS. 5 and 6—and thus press the frame 4, and hence the sealing element 46, 76, respectively, against the frame leg 44. The movement of the projections 60 is transferred to the frame 4 by engagement of the projections with an abutment stop 52 formed on the frame 4. Thus, as the projections 60 engage the abutments 52, the frame 4 is lifted in the direction of the arrows E, and presses the sealing strips 46 against the end of the leg 44 of the fixed frame, thus sealing the window or panel 17 against the body 1 of the stove, and completely sealing the combustion chamber. Combustion air, thus, can reach the combustion chamber only through the openings 8 of the air inlet control arrangement or system 10, under control of the slider 14 with its slits 19.

To permit easy sliding of the panel or window 17 in its frame 4, compression springs 38 (FIG. 7) are provided to press the frame 4 into released position when the noses or projections 60 are disengaged from the abutment 52. A plurality of springs 38 are used, located in spaced position around the frame 42. The springs 38 have a centering arrangement, including a bolt 40, screwed into a threaded strip or a nut 49 secured to the frame 4. The other end of the bolt 40 includes a head 45 and is axially slidably received in a bushing 36. When the frame 4 is pressed against the leg 44 of the frame 42, the bolt 40 can slide in the space 47 above the head 45, permitting the spring 38 to be compressed. When the pressure is released, by moving the lever 58 from the position of FIG. 6 to FIG. 5, the springs move the frame 4 out of engagement with the legs 44. This permits easy movement of the disk and frame 4, longitudinally, in the ball or vertical roller arrangement 50.

Figure 7:
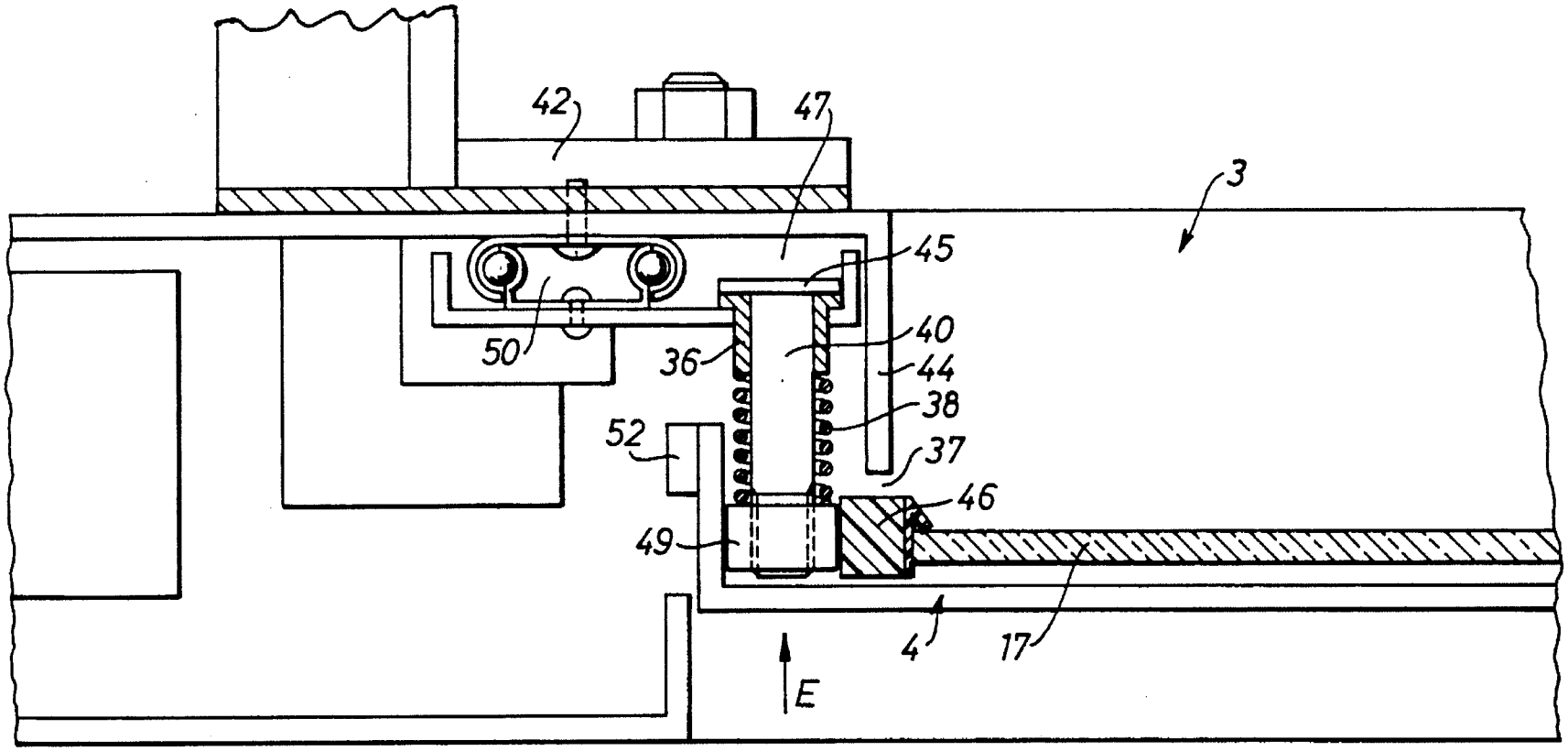
FIG. 7 is a fragmentary cross section through the sealing elements and illustrating release springs for the panel.
Figure 8:
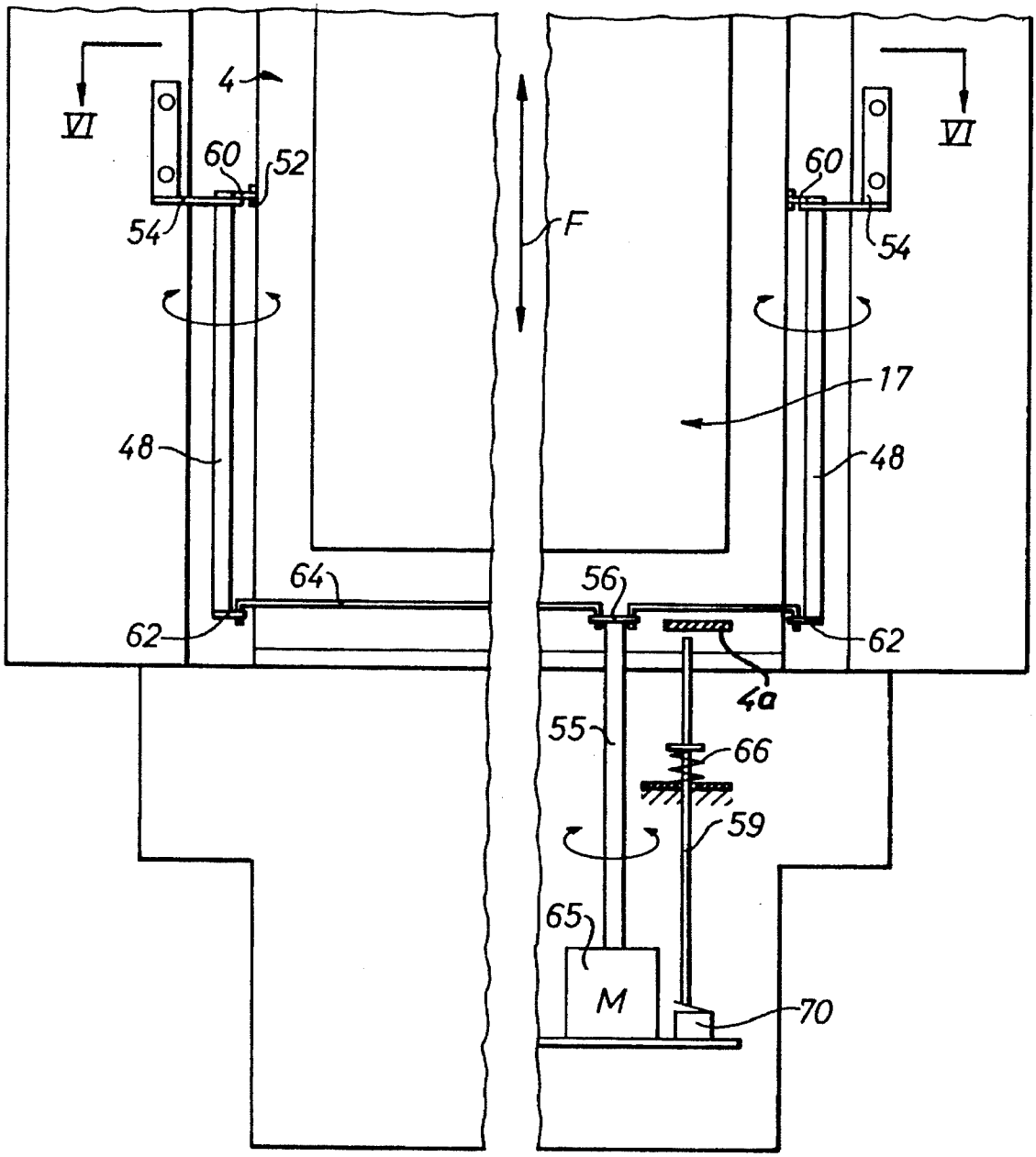
FIG. 8 is a highly schematic view of a motorized arrangement to provide a seal for the panel.

The spring release arrangement shown in FIG. 7 has been omitted from FIGS. 5 and 6 for clarity of the drawings.

FIG. 8 illustrates another arrangement to lock the window in sealed position, in which the hand lever 58 is replaced by a motor drive. An electric motor 65, shown only as block M, is coupled by a drive rod 55 with the rotary disk 56. In all other respects, the structure is identical to that described in connection with FIGS. 5–7. In order to ensure that the panel 17 is in proper position within the sealing frame, an electric interlock control system is provided which permits engagement of the frame 4 against the leg 44 of the stationary frame 42 only when the frame 4 is in properly closed position; likewise, release can be effected only from this position. An operating rod 59 is located on the body of the stove 1, and so dimensioned that its upper end can cooperate with the frame 4. The rod 59 is spring-loaded by a spring 66. The lower end of the rod 59, which is slidable in the body of the stove, operates a switch 70 which permits energization of the motor only when the frame 4 is in its lowest, that is, closed position. This prevents possible blocking of the panel 17 in intermediate positions. To permit easy location of the rod 59, the frame 4 can be formed with an engagement projection 4*a*.

Sealing the combustion chamber in operation of the stove, and controlling the air flow for combustion, permits operation at high combustion efficiency with a minimum of polluting exhaust gases. On the other hand, a slidable, vertically operating panel, which can slide easily when in unsealed condition, is user-friendly because it permits easy refilling of the combustion chamber with fuel.

Air to be heated, introduced into the stove body 1 through the air inlet opening 5, is passed through a heat exchanger 12 located above the combustion chamber 3, and then leaves the heater 1 through two openings or pipe or duct couplings 6 at the top of the heater. From there, heated air, which is not contaminated by combustion or flue gases, is conducted to heat storage blocks, to be then either emitted as hot air for hot air heating into the space to be heated or, alternatively, recycled through the opening 5, for example with a suitable control valve or damper arrangement.

Figure 19:
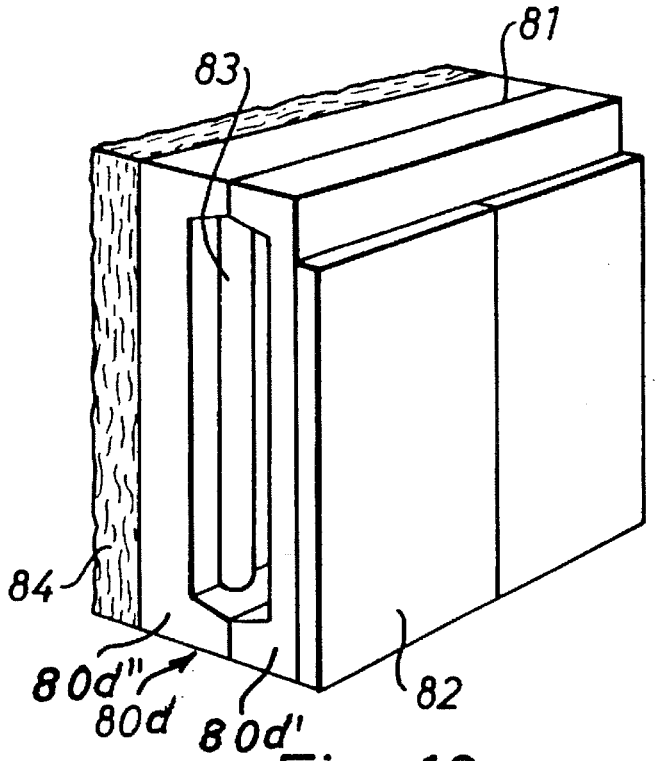
FIG. 19 is a schematic, perspective view of a heat storage block with a heat radiating tile facing.
Figure 20:
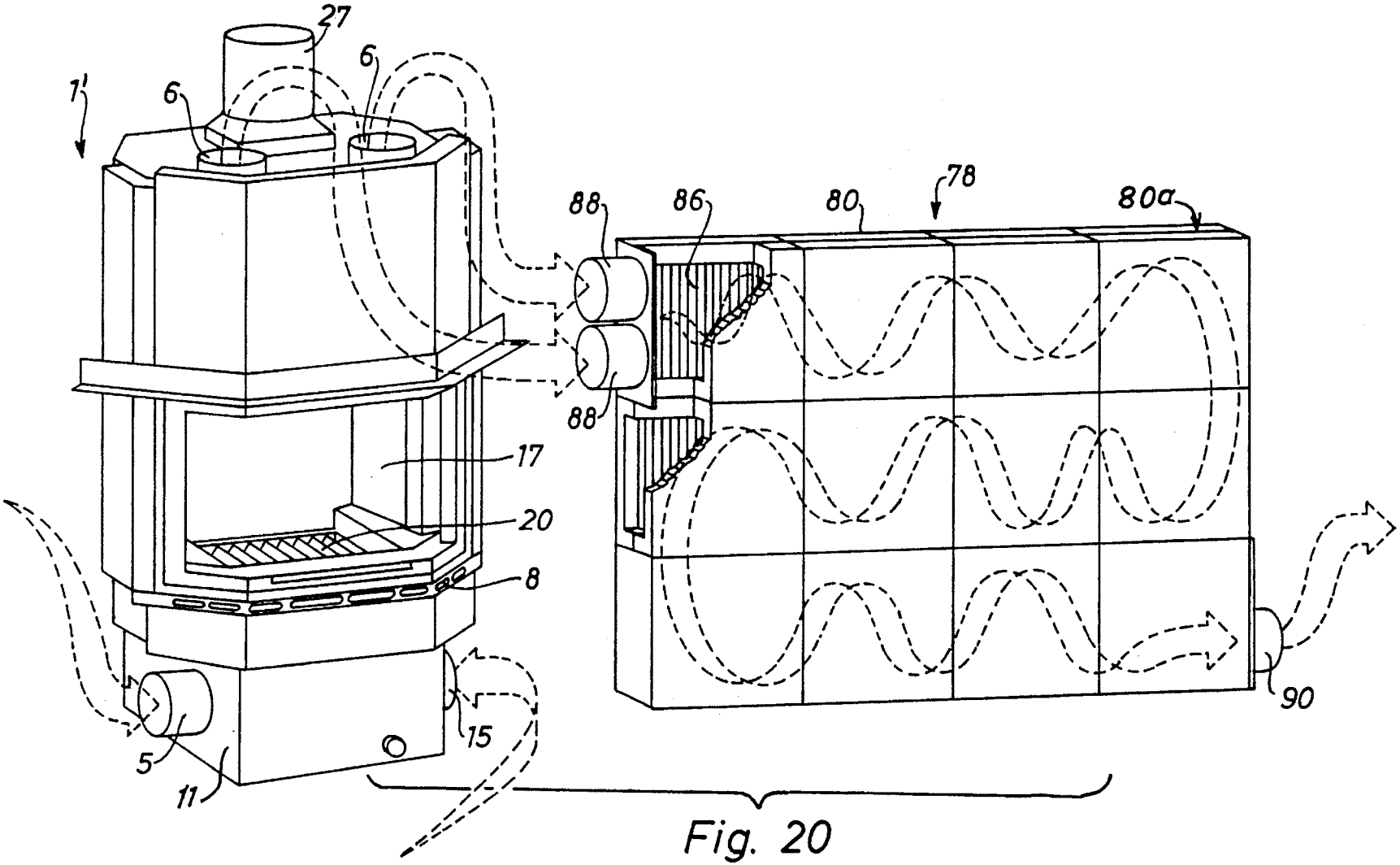
FIG. 20 is a highly schematic view of the space heating system using a heat radiating wall, and illustrating another form for the outer shape of the stove.

FIGS. 10–19 illustrate various heat storage blocks 80. Heated walls, heated benches or floor heating structures can be constructed in suitable sizes and configurations by using heating blocks of which only few need be different. As best seen in FIG. 20, the hot air generated in the stove 1' is guided through such a heating system formed by a plurality of blocks 80. The hot air which is passed through the blocks 80 is only the air which is heated in the heat exchanger 12, and does not include flue or combustion gases, so that the spaces within the blocks remain clean and will not be subject to soot or other deposits.

Figure 14:
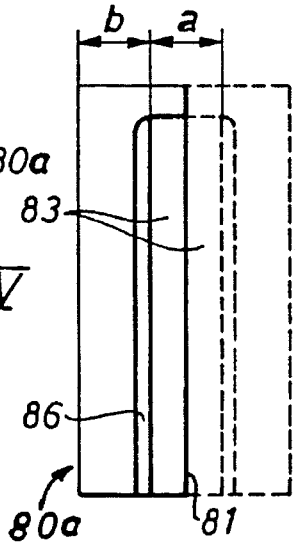
FIG. 14 is a side view of the half block of FIG. 13.
Figure 15:
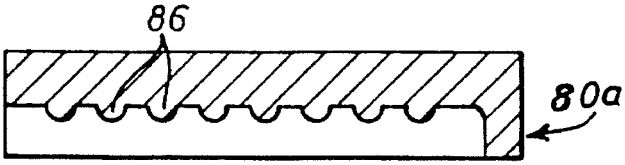
FIG. 15 is a cross section along line XV—XV of FIG. 13.

The blocks 80 are made of chamotte. In general, they are, in plan view, rectangular and constructed of two half-blocks or elements separated from each other and, in use, engaged against each other at engagement surfaces 81. The reason for this construction is that it is much easier to make air duct and heat storage blocks in two parts, and then joining them together by a suitable heat-resistant cement, so that they will be retained together without danger of separation. Yet, between two opposite sides, an open hollow space will result. The hollow space 83, see FIG. 14, is not smooth in its interior but, rather, is formed with obstructions to improve heat transfer between the hot air and the material of the block. These obstructions, preferably, are longitudinal ribs 86, which extend throughout the blocks between the upper and lower wall 85. Preferably, the ribs are rounded at the sides facing the hollow space 83, and terminate inwardly at sharp corners. They are integral with the block, so that the ribbed half-blocks are unitary structures. The ribs 86 extend transversely to the flow or stream direction shown by arrows S, FIGS. 10, 13 and 16, of the hot air passed through the blocks, and provide for turbulence and hence good heat transfer. The hot air flows between the side edges 87.

Alternatively, the ribs can be differently constructed, as desired, for example they can be rounded at the base, where they merge into the remainder of the structure, and may have any suitable shape at the outer edge including, for example, sharp corners.

If it is desired to deflect the warm air about right angles, a deflection block 80*a* (FIGS. 13–15) is suitable. The principle of construction is similar to that illustrated in connection with block 80, FIGS. 10–12, with the difference, however, that it is open at two adjacent sides which are at a 90° angle with respect to each other; the corner which is opposite the open sides is formed with a concave 90° wall 92 to deflect the flow of air through the space between two blocks fitted against each other. The two blocks are mirror-image identical and located one over the other. Thus, heated air can be deflected by 90°, see block 80*a* of FIG. 20. Air flow is between sides 87*a* and 87*a'*.

Figure 10:
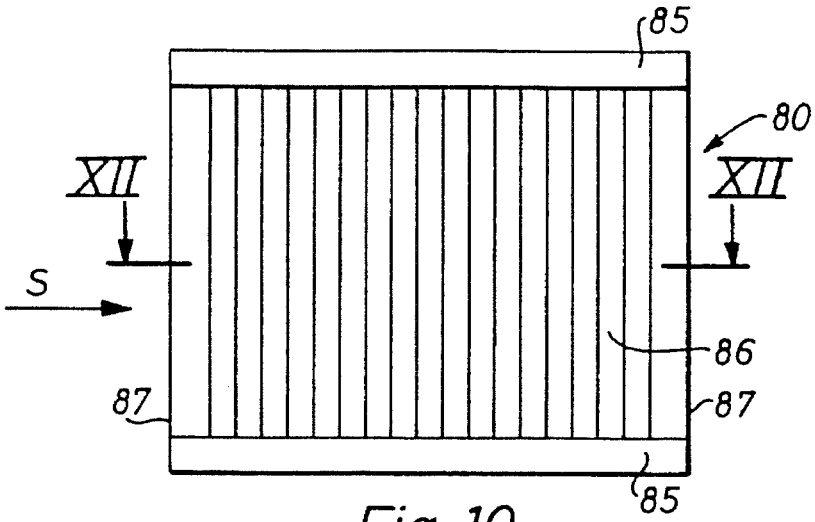
FIG. 10 is a front view of half of a hollow heat storage and heat radiating block.
Figure 11:
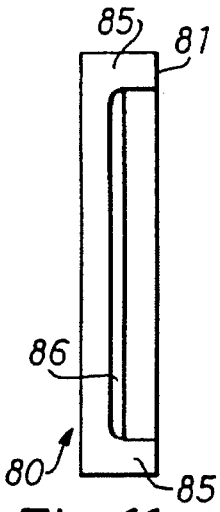
FIG. 11 is a side view of the block of FIG. 10.
Figure 12:
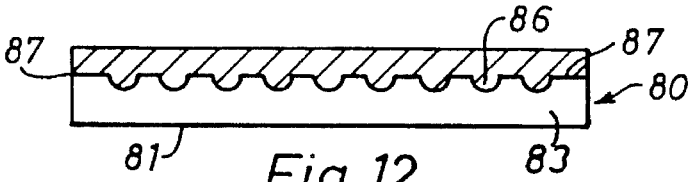
FIG. 12 is a cross section along line XII—XII of FIG. 10.
Figure 13:
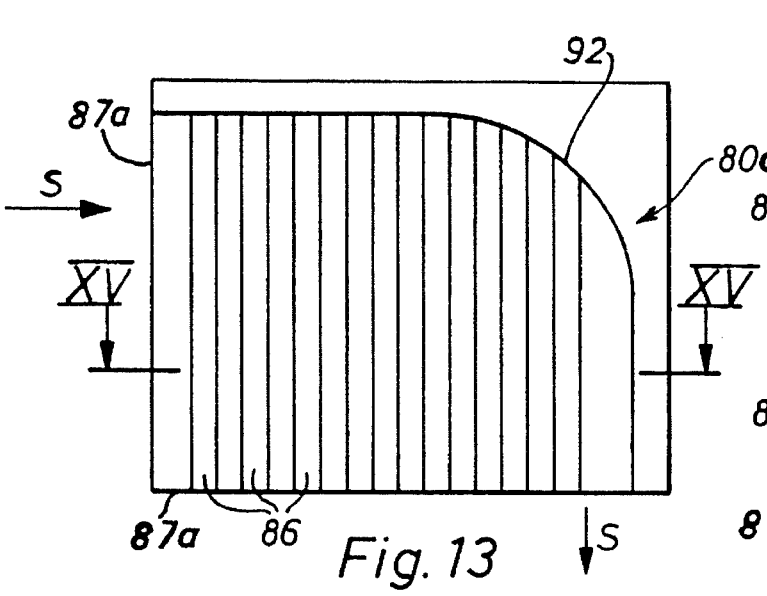
FIG. 13 is a front view of half of a heat storage block having a flow direction changing arrangement therein.
Figure 16:
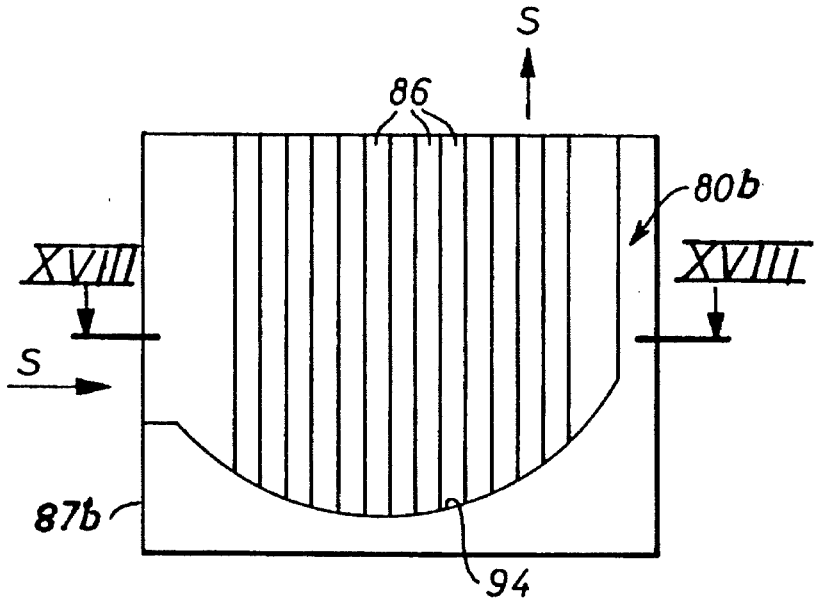
FIG. 16 is a front view of half of a heat storage and radiating block and illustrating another air stream directing arrangement.
Figure 17:
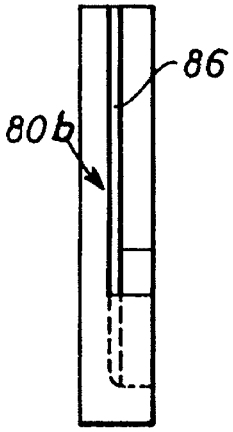
FIG. 17 is a side view of the block of FIG. 16.
Figure 18:
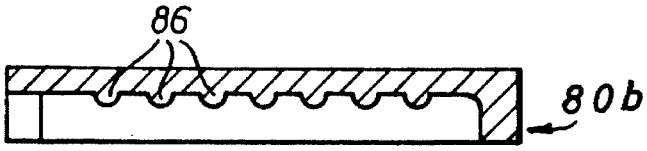
FIG. 18 is a cross section along line XVIII—XVIII of FIG. 16.

FIGS. 16–18 illustrate another construction of a block 80*b* which, again, is open at two adjacent sides 87*b*, 87*b'*, that is, is not formed with an edge wall similar to edge walls 85 (FIGS. 10–12). A rounded, concave solid wall 94 terminates the wall opposite the open deflected wall 87*b'*. The rounding extends over an arc, preferably, of about 120°. Air introduced in the direction S through wall 87*b* is then deflected to leave the block 80*b* in upward direction at wall 87*b'*. This provides for particularly good heat transition and heat transfer to the adjacent blocks.

Rather than using ribs 86, other obstructions can be placed to cause turbulence and retard air flow within the respective blocks, for example a plurality of bumps, button-like projections or other flow-impeding elements, projecting from a smooth surface.

It is not necessary that the block elements which are fitted against each other have the same wall thickness. Referring to FIG. 19: The block 80*d* shows that one of the block elements may have a lesser wall thickness, so that a tile or similar decorative and wear-resistant element can be placed thereagainst. The tile 82, for example, can form part of a decorative wall, a bench surrounding the stove 1 or 1' or the like If heat is not to be transmitted to the side opposite the tile 82, a heat insulating panel 84 can be placed against the block 80*d*.

Typical dimensions for the tile 80*d* are, for example: The thinner block element 80*d'* has a wall thickness b (FIG. 14) measured up to the extent of the obstruction 86 which is about 0.3 to 0.7 times the clear spacing 83 between the elements, from tip to tip of the obstructions 86. The dimension of spacing 83 is shown as a in FIG. 14. A preferred factor is about 0.5 times the clear space a of the clear region 83 between the two block elements or halves 80*d'* and 80*d''* (FIG. 19).

If the blocks 80, 80*a*, 80*b*, 80*c* have the same thickness, a suitable dimension a of the clear passage 83 for air, from tip to tip of the obstructions, is about 0.8 to 1.6 times the wall thickness b measured to the tip of the obstructions 81. This provides for suitable heat transfer and heat storage by the blocks 80, 80*a*, 80*b*, 80*c* without essential interference with air flow.

FIG. 20, highly schematically, shows the construction of a heat storage and heat radiating wall 78, coupled to a stove 1'. Using the respective blocks described in connection with FIGS. 10–19, hot air will flow through the wall 78, the hot air transmitting heat to the respective blocks 80, 80*a*, 80*b*, 80*c*, 80*d*. The hot air wall 78 includes two parallel air duct connections 88 for hot air supplied by the stove or furnace 1. The wall 78 may, however, be constructed in various ways, and need not be flat, but can be angular. It is only necessary to then form the blocks 80 accordingly. By locating a wall 78 horizontally, benches and the like can be built, providing radiant heat therefrom. The blocks can also be constructed for floor heating, in which case use of back-up insulation 84 (see FIG. 19) is suitable.

In the arrangement of FIG. 20, hot air is emitted from the wall 78 by an outlet duct 90. Air to be heated is supplied to the heat exchanger 12 in the stove 1' by connecting a suitable air duct to the connecting stub or pipe 5 located in the base 11 (FIG. 1) of the stove. A further inlet duct or pipe 15 (FIG. 20) may be provided to supply recirculating air from the inside of the space being heated. Vanes, dampers, or other air flow control arrangements can be used to control the proportion of fresh air and recirculating air. The air to be heated then travels from the base 11 at the back side of the combustion chamber 3 upwardly into at least one heat exchanger 12 and leaves the stove or heater 1, 1' via hot-air outlets 6; preferably, more than one hot-air outlet stub or duct connection 6 is provided. The connection between selected ones of the hot-air outlet stubs 6 and inlet stubs 88 on the heating wall 78 can be done, conventionally, by suitable hot-air ducts, not further illustrated.

The outlet 90 can emit the hot air into the ambient space to be heated; in an alternative, the outlet 90 can be coupled to the inlet stub 15 in the base 11 of the furnace or stove, for reheating of air which has passed through the wall 78. Suitable deflection plates or vanes can be provided to control the amount of air emitted into the space to be heated, or recirculated through the heater 1, 1'.

Various changes and modifications may be made, and any features described herein may be used with any of the others, within the scope of the inventive concept.

I claim:

1. A space heating system comprising a space heater (1, 1') having a housing (2) including a combustion chamber (3) and a front wall formed with a fuel inlet opening (7) leading to the combustion chamber (3);

a movable panel element (17) selectively covering said inlet opening, or leaving it accessible for introduction of fuel;

a heat exchanger (12) located above the combustion chamber (3) and having exchange heat inlet means (5) leading to the heat exchanger (12) and exchanged heat outlet means (6) for conducting heated air away from the heat exchanger;

combustion air inlet means (10, 19) for controlled supply of combustion air to the combustion chamber (3);

air duct means (23, 24) coupled to the air inlet means (10, 19) to supply air from the air inlet means to the combustion chamber (3);

a panel retention frame system (4, 42) to retain said panel element (17) for vertical sliding movement between a covered position covering said opening (7), and an open position, a plurality of hollow heat storage and radiating blocks (80, 80*a* . . .) pneumatically coupled to the heated air outlet means (6), said blocks being coupled together and connected for continuous heated air flow through said coupled hollow blocks, said coupled blocks forming a heatable wall or heat panel structure;

wherein said hollow heat storage blocks 180, 80*a* . . .) are of essentially rectangular, optionally square outline, and are formed of dual mirror-symmetrical matching block elements, rigidly connected together; and wherein the surfaces of said hollow blocks defining the interior hollow space are formed with interior air flow obstructions (86), integral with the material of the respective block element, to generate turbulence in the heated air flow passing through the interior space.

2. The system of claim 1, wherein said hollow heat storage blocks (80, 80*a* . . .) include a plurality of sets having different hollow regions, wherein a first set of blocks (80) has oppositely located sides (87) open for passage of heated air therethrough, and another set of blocks (80*a*) has adjacent sides (87*a*, 87*a*') open to air flow therethrough, said adjacent sides being angularly positioned with respect to each other by 90°; and wherein the interior space of the hollow blocks of the other set is bounded by a 90° deflection wall (92).

3. The system of claim 1, wherein said hollow heat storage blocks (80, 80*a* . . .) are formed of two block elements, mirror-symmetrically identical to each other, and rigidly connected to each other;

and wherein at least one of said blocks (80*d*) has a block element (80*d*') which has a wall thickness (b) which is less than the wall thickness of the other (80*d*) mirror-symmetrical block element;

and a tile (82) applied to an outer surface of the block element (80*d*') of lesser wall thickness.

4. The system of claim 1, wherein said hollow heat storage blocks (80, 80*a* . . .) are formed of connected, mirror-identicalhalf-block elements, each having internally extending obstructions (86), optionally ribs, to generate turbulence within the interior of the hollow blocks; and wherein the clear space (83) in the hollow blocks, measured (a) from the tip to the tip of said interior obstructions, is between about 0.8 and 1.6 times the wall thickness (b) of one block element measured from an outer surface of the respective block to the tip of the interior obstruction (86).

5. The system of claim 1, wherein said air duct means (23, 24) include a primary air duct system (24) and a secondary air duct system (23), said secondary air duct system (23) comprising essentially vertically positioned air conduits (30), which conduits are located within the combustion chamber (30);

a fuel support grate (25) located at the bottom of the combustion chamber;

an ash receiver (18);

wherein the primary air duct means (24) communicates with a prewarming space (21) surrounding the ash receiver; and a frame (16) surrounding the ash receiver (18) at an upper region thereof adjacent the grate (25) and defining an air flow space (22) between the grate and the upper region of the ash receiver, said air flow space (22) being in air communication with said prewarming space (21) and defining an essentially horizontal flat areal zone for passage of secondary air in the secondary air duct system upwardly through the grate (25).

6. The system of claim 5, wherein said panel frame system comprises a fixed frame portion (42) secured to the housing and a movable frame portion (4) separable from the fixed frame portion and retaining said panel;

engagement means (52, 60) operatively coupled to the flat side of the panel (17) to selectively move the flat side of the panel in sealing position against the fixed frame portion (42) and seal the combustion chamber against uncontrolled ingress of air upon operation of said engagement means; and a release means (38) operatively engageable with the panel (17) to release the panel from sealed position upon release of the panel by releasing operation of the engagement means.

7. The system of claim 1, wherein said panel element (17) is sealingly engageable against said housing to seal the combustion chamber (3) within the housing.

8. In a space heating system, a space heater (1, 1') comprising a housing (2) including a combustion chamber (3) and a front wall formed with a fuel inlet opening (7) leading to the combustion chamber (3);

a movable panel element (17) selectively covering said inlet opening, or leaving it accessible for introduction of fuel;

a heat exchanger (12) located above the combustion chamber (3) and having exchange heat inlet means (5) leading to the heat exchanger (12) and exchanged heat outlet means (6) for conducting heated air away from the heat exchanger;

combustion air inlet means (10, 19) for controlled supply of combustion air to the combustion chamber (3);

air duct means (23, 24) coupled to the air inlet means (10, 19) to supply air from the air inlet means to the combustion chamber (3);

wherein said air duct means (23, 24) include a primary air duct system (24) and a secondary air duct system (23), said secondary air duct system (23) comprising essentially vertically positioned air conduits (30), which conduits are located within the combustion chamber (30);

a fuel support grate (25) located at the bottom of the combustion chamber;

an ash receiver (18);

wherein the primary air duct means (24) communicates with a prewarming space (21) surrounding the ash receiver; and a frame (16) surrounding the ash receiver (18) at an upper region thereof adjacent the grate (25) and defining an air flow space (22) between the grate and the upper region of the ash receiver, said air flow space (22) being in air communication with said prewarming space (21) and defining an essentially horizontal flat areal zone for passage of secondary air in the secondary air duct system upwardly through the grate (25).

9. The space heater of claim 8, wherein said frame (16) is formed with lateral air passage openings (32) communicating said prewarming space (21) with said air flow space (22).

10. The space heater of claim 8, wherein at least two essentially vertically positioned air conduits (30) are provided, one at each lateral side of the combustion chamber (3), and a cross-connecting duct (34) interconnecting said vertically directed conduits (30), said cross-connecting duct being formed with outlet openings (35) directing air downwardly into said combustion chamber (3).

11. The space heater of claim 10, wherein said openings (35) direct air towards said panel element (17).

12. The space heater of claim 8, wherein said ash receiver (18) is suspended on said frame (16).

13. In a space heating system, a space heater (1, 1') comprising a housing (2) including a combustion chamber (3) and a front wall formed with a fuel inlet opening (7) leading to the combustion chamber (3);

a movable panel element (17) selectively covering said inlet opening, or leaving it accessible for introduction of fuel;

a heat exchanger (12) located above the combustion chamber (3) and having exchange heat inlet means (5) leading to the heat exchanger (12) and exchanged heat outlet means (6) for conducting heated air away from the heat exchanger;

combustion air inlet means (10, 19) for controlled supply of combustion air to the combustion chamber (3);

air duct means (23, 24) coupled to the air inlet means (10, 19) to supply air from the air inlet means to the combustion chamber (3);

wherein said panel frame system comprises a fixed frame portion (42) secured to the housing and a movable frame portion (4) separable from the fixed frame portion and retaining said panel;

engagement means (52, 60) operatively coupled to the flat side of the panel (17) to selectively move the flat side of the panel in sealing position against the fixed frame portion (42) and seal the combustion chamber against uncontrolled ingress of air upon operation of said engagement means; and a release means (38) operatively engageable with the panel (17) to release the panel from sealed position upon release of the panel by releasing operation of the engagement means; and wherein said release means (38) comprise a plurality of compression springs (38) positioned to bias the panel element away from the stationary frame portion (42) to permit free sliding movement of said movable frame portion (4) and hence of said panel element (17).

14. The space heater of claim 13, wherein two engagement means are provided, one each located adjacent a respective lateral edge of said panel (17);

and operating means (56, 58, 62, 64) are provided, engageable with said engagement means (52, 60) for commonly engaging said engagement means to move the panel in sealing position or release it from sealing position, said operating means including a rotatable element (56), and rod or link means (64) coupling said element with said engagement means (52, 60);

a rod (48) rotatable about a rod axis, coupled to said element (56); and means for rotating said rod, to thereby move said link elements (64) and, selectively, move the engagement means into sealing or released position.

15. The space heater of claim 14, wherein said means for rotating said rod (48) comprise a manual lever (58).

16. The space heater of claim 14, wherein said means for rotating said rod (48) comprise an electric motor (65), and interlocking switch means (70) electrically coupled to said motor and responsive to the position of said frame on the housing (2) and permitting operation of the motor to rotate said disk element (56) and hence move the engagement means into sealed position only when the panel element is positioned in front of said fuel inlet opening (7).

17. The space heater of claim 13, further including a sealing element secured to one of said frame portions (4) and engageable by the other frame portion, said sealing element comprising at least one leaf spring (76).

18. The space heater of claim 17, further including a sealing element secured to one of said frame portions (4) and engageable by the other frame portion, said sealing element comprising a compressible sealing strip.

19. The space heater of claim 13, wherein said air duct means (23, 24) include a primary air duct system (24) and a secondary air duct system (23), said secondary air duct system (23) comprising essentially vertically positioned air conduits (30), which conduits are located within the combustion chamber (30);

a fuel support grate (25) located at the bottom of the combustion chamber;

an ash receiver (18);

wherein the primary air duct means (24) communicates with a prewarming space (21) surrounding the ash receiver; and a frame (16) surrounding the ash receiver (18) at an upper region thereof adjacent the grate (25) and defining an air flow space (22) between the grate and the upper region of the ash receiver, said air flow space (22) being in air communication with said prewarming space (21) and defining an essentially horizontal flat areal zone for passage of secondary air in the secondary air duct system upwardly through the grate (25).

* * * * *